US009079074B2

(12) United States Patent
Lindsey et al.

(10) Patent No.: US 9,079,074 B2
(45) Date of Patent: Jul. 14, 2015

(54) SPORTS TRAINING DEVICE

(76) Inventors: John David Lindsey, Alexandria, VA (US); Scott M. Rix, Fairfax Station, VA (US)

( * ) Notice: Subject to any disclaimer, the term of this patent is extended or adjusted under 35 U.S.C. 154(b) by 55 days.

(21) Appl. No.: 13/450,415

(22) Filed: Apr. 18, 2012

(65) Prior Publication Data

US 2012/0270685 A1 Oct. 25, 2012

Related U.S. Application Data

(60) Provisional application No. 61/477,811, filed on Apr. 21, 2011.

(51) Int. Cl.

| | |
|---|---|
| ***A63B 69/00*** | (2006.01) |
| ***A63B 37/00*** | (2006.01) |
| ***A63B 37/12*** | (2006.01) |
| ***A63B 43/06*** | (2006.01) |
| *A63B 59/06* | (2006.01) |

(52) U.S. Cl.

CPC ..... *A63B 37/12* (2013.01); *A63B 43/06* (2013.01); *A63B 37/0003* (2013.01); *A63B 59/06* (2013.01); *A63B 2207/00* (2013.01); *A63B 2220/53* (2013.01)

(58) Field of Classification Search

CPC .... A63B 43/06; A63B 43/00; A63B 2220/83; A63B 2071/0636; A63B 71/0638

USPC ..... 473/422, 570, 603–611

See application file for complete search history.

(56) References Cited

U.S. PATENT DOCUMENTS

| | | | | | |
|---|---|---|---|---|---|
| 3,436,076 | A | * | 4/1969 | Barthol | 473/457 |
| 3,580,575 | A | * | 5/1971 | Speeth | 473/570 |
| 3,731,928 | A | * | 5/1973 | Wolfe | 473/451 |
| 4,235,441 | A | * | 11/1980 | Ciccarello | 473/267 |
| 5,054,778 | A | * | 10/1991 | Maleyko | 473/570 |
| 5,439,408 | A | * | 8/1995 | Wilkinson | 446/409 |
| 5,603,497 | A | * | 2/1997 | Louez | 473/609 |
| 5,639,076 | A | * | 6/1997 | Cmiel et al. | 473/570 |
| 5,692,946 | A | * | 12/1997 | Ku | 473/570 |
| 5,779,574 | A | * | 7/1998 | Allman et al. | 473/570 |
| 5,820,495 | A | * | 10/1998 | Howland | 473/451 |
| 5,888,156 | A | * | 3/1999 | Cmiel et al. | 473/570 |
| 2013/0040767 | A1 | * | 2/2013 | Gill | 473/465 |

FOREIGN PATENT DOCUMENTS

| | | | | | |
|---|---|---|---|---|---|
| EP | 2163282 | A1 | * | 3/2010 | A63B 43/06 |
| FR | 2202259 | A | * | 6/1974 | F21V 17/00 |
| GB | 1216031 | A1 | * | 12/1970 | A63B 69/00 |

* cited by examiner

*Primary Examiner* — Mitra Aryanpour
(74) *Attorney, Agent, or Firm* — Lyman H. Smith

(57) ABSTRACT

An athletic training device trains athletes to observe the collision between a ball and bat, club, racquet, or the like. The training device may provide a unique event, such as a flashing light, at the moment of the collision. Athletes can be trained to watch the ball, bat, club, racquet or the like, to note the flash of light, thereby focusing the attention of the athlete to "keep their eye on the ball". The training device of the present invention can provide a unique event that attracts and induces anticipation from the collision point itself. The unique event can be a light flash, multiple light flashes, colored light flashes, or the like.

10 Claims, 7 Drawing Sheets

SPORTS TRAINING DEVICE

CROSS-REFERENCE TO RELATED APPLICATIONS

This application claims the benefit of priority of U.S. provisional patent application No. 61/477,811, filed Apr. 21, 2011, the contents of which are herein incorporated by reference.

BACKGROUND OF THE INVENTION

The present invention relates to sports training devices and, more particularly, to a device that uses a flash of light produced at a precise moment to train focus and concentration at the point of impact to facilitate hitting an object, such as a baseball, softball, golf ball, tennis ball, and the like.

Athletes may take their eyes off the ball prior to completing an athletic movement or sequence, such as swinging a bat. For instance, baseball hitters may not follow the entire trajectory of a baseball and actually observe the collision between the baseball and bat. It is well known in the art that watching the baseball as it is being struck facilitates effective hitting. Athletes need something that can help focus their concentration at a precise moment and place to train them to observe the point of impact.

Numerous conventional drills, devices and tools are used to train athletes of several sports, such as baseball, golf and tennis, to keep their eyes on the ball and observe the collision. Athletes are coached to hit a round ball squarely with the sweet spot of the bat, club, racket, or the like. They must do this during a collision that takes place in an instant. Conventional devices and tools, that do not provide a unique event that attracts and induces anticipation from the collision point itself, do not adequately address the problem of athletes not observing the collision.

As can be seen, there is a need for a training tool to attract and induce anticipation of the collision point in an athletic motion or sequence, such as a bat, club or racquet striking a ball.

SUMMARY OF THE INVENTION

In one aspect of the present invention, a training device comprises an impact sensing mechanism adapted to sense an impact with or by the training device; a logic circuit receiving a signal from the impact sensing mechanism when the impact sensing mechanism senses the impact; and a light generating mechanism receiving an illumination signal from the logic circuit to cause an illumination event comprised of one or more flashes of at least one light for a combined duration of less than 1,000 milliseconds.

In another aspect of the present invention, a method for training athletes to watch a ball at a point of impact with a striking object comprises detecting an impact between the ball and the striking impact; determining a color for lighting at least one light on either the ball or the striking object; and producing at least one flash of light in the at least one light at an impact time; wherein the at least one flash of light in the at least one light occurs for a combined duration of less than 1,000 milliseconds.

In a further aspect of the present invention, a training device comprises an impact sensing mechanism adapted to sense an impact with or by the training device; a logic circuit receiving a signal from the impact sensing mechanism when the impact sensing mechanism senses the impact; and a light generating mechanism receiving an illumination signal from the logic circuit to cause at least one light to illuminate, wherein each illumination event is adapted to illuminate the at least one light in at least one of a selected color and a pattern, wherein the selected color or pattern is selected from one of a plurality of available colors.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an athletic training device that trains athletes to observe the collision between a ball and bat, club, racquet, or the like. The training device may provide a unique illumination event, such as a flash of light, at the moment of the collision. Athletes can be trained to watch the ball, bat, club, racquet or the like, to note the flash of light, thereby focusing the attention of the athlete to "keep their eye on the ball". The training device of the present invention can provide a unique event that attracts attention and induces anticipation from the collision point itself. The unique illumination event can be a light flash, multiple light flashes, colored light flashes, or the like. A coach may ask players to identify the light, for example, by its color, to help focus the attention of the players.

Figure 1:
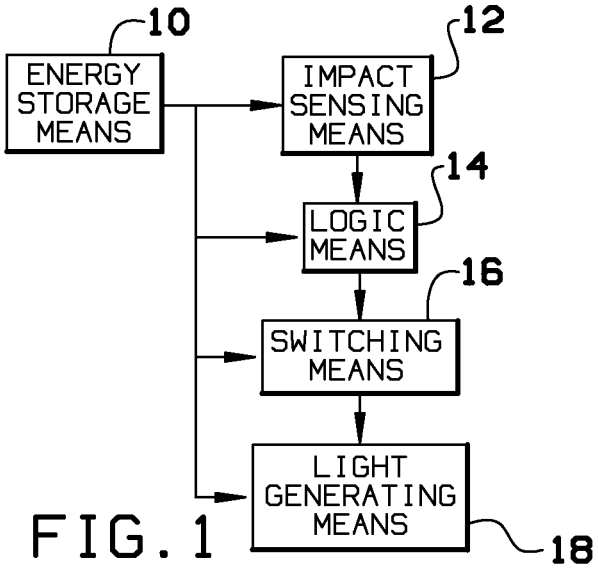
FIG. 1 is a schematic diagram describing various components in the training device according to an exemplary embodiment of the present invention.

Referring to FIG. 1, an exemplary embodiment of a training device can include an energy storage means 10, an impact sensing means 12, a logic means 14, a switching means 16, and a light generating means 18.

The energy storage means 10 provides electrical power for the circuitry of the training device. The energy storage means 10 includes, for example, three AAAA style 1.5 volt alkaline batteries wired in series to provide a nominal 4.5 volt supply. Other energy storage means may be substituted, including batteries with different form factors, chemistries, voltages, and configurations. Alternately, a capacitor, supercapacitor, or rechargeable battery might be used. The training device might also incorporate a means to transform mechanical energy from motion or impact into electrical energy to power the circuitry, using common techniques known in the art, such as piezoelectric and/or magnet and coil means.

Figure 2:
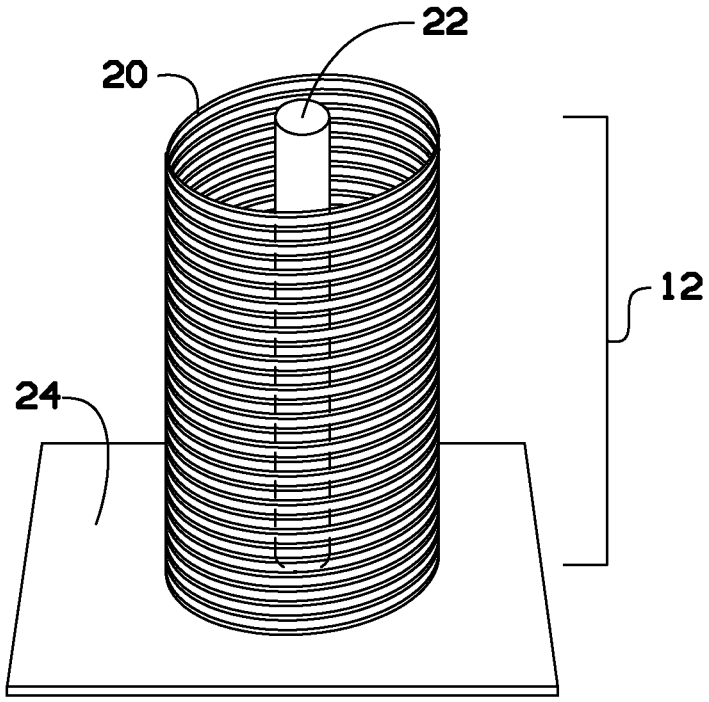
FIG. 2 is an exemplary impact sensing mechanism of the training device of the present invention.

The impact sensing means 12 provides a mechanism to detect acceleration of a magnitude sufficient to infer that a mechanical strike, hit, or impact has occurred. As shown in FIG. 2, the impact sensing means 12 of the present invention employs an electrically-conductive cantilevered spring 20 with a coaxial electrical-conductive header pin 22. In an exemplary embodiment, both the cantilevered spring 20 and the header pin 22 are attached at one end to a circuit board 24. Mechanical shock resulting from striking, hitting, or impacting the preferred embodiment causes the cantilevered spring 20 to flex and contact the header pin 22. The cantilevered spring 20 contacting the header pin 22 provides an electrically conductive path between the two components that operates as a momentary switch. As shown in circuit diagram in FIG. 3, the header pin 22 is electrically connected to an input of the logic means 14 that is biased with a resistor, such as a 100 kOhm resistor, to the circuit positive potential. When mechanical acceleration causes the cantilevered spring 20 to contact the header pin 22, the input to the logic means 14 changes from the circuit positive potential to the circuit ground potential.

The cantilevered spring 20 may oscillate after a mechanical impact, but returns to the open switch state once the training device is at rest. The sensitivity of the impact sensing means 12 may be tuned by using a different length, geometry, or material for the cantilevered spring 20.

There are many suitable alternatives available in the art for measuring and detecting mechanical acceleration and impact, including mechanical, piezoelectric, piezoresistive, capacitive, and/or MEMS accelerometers as well as springs in other geometries and orientations.

As outlined in FIG. 1, the logic means 14 receives a signal from impact sensing means 12, determines the necessary flash parameters, and controls the output of the light generating means 18 through the switching means 16. As shown in circuit schematic of FIG. 3, the logic means in an exemplary embodiment is a PIC10F200 programmable 8-bit microcontroller, sold by Microchip Technology Inc., 2355 West Chandler Blvd., Chandler, Ariz., USA 85224.

There are many alternatives available to substitute for the logic means 14. Analog components, discrete logic components, or other microprocessors or microcontrollers are all contemplated within the scope of the present invention. Any component or network of components that can cause a flash or sequence of light in one or more colors and/or durations in response to a detected acceleration or impact is suitable.

Figure 3:
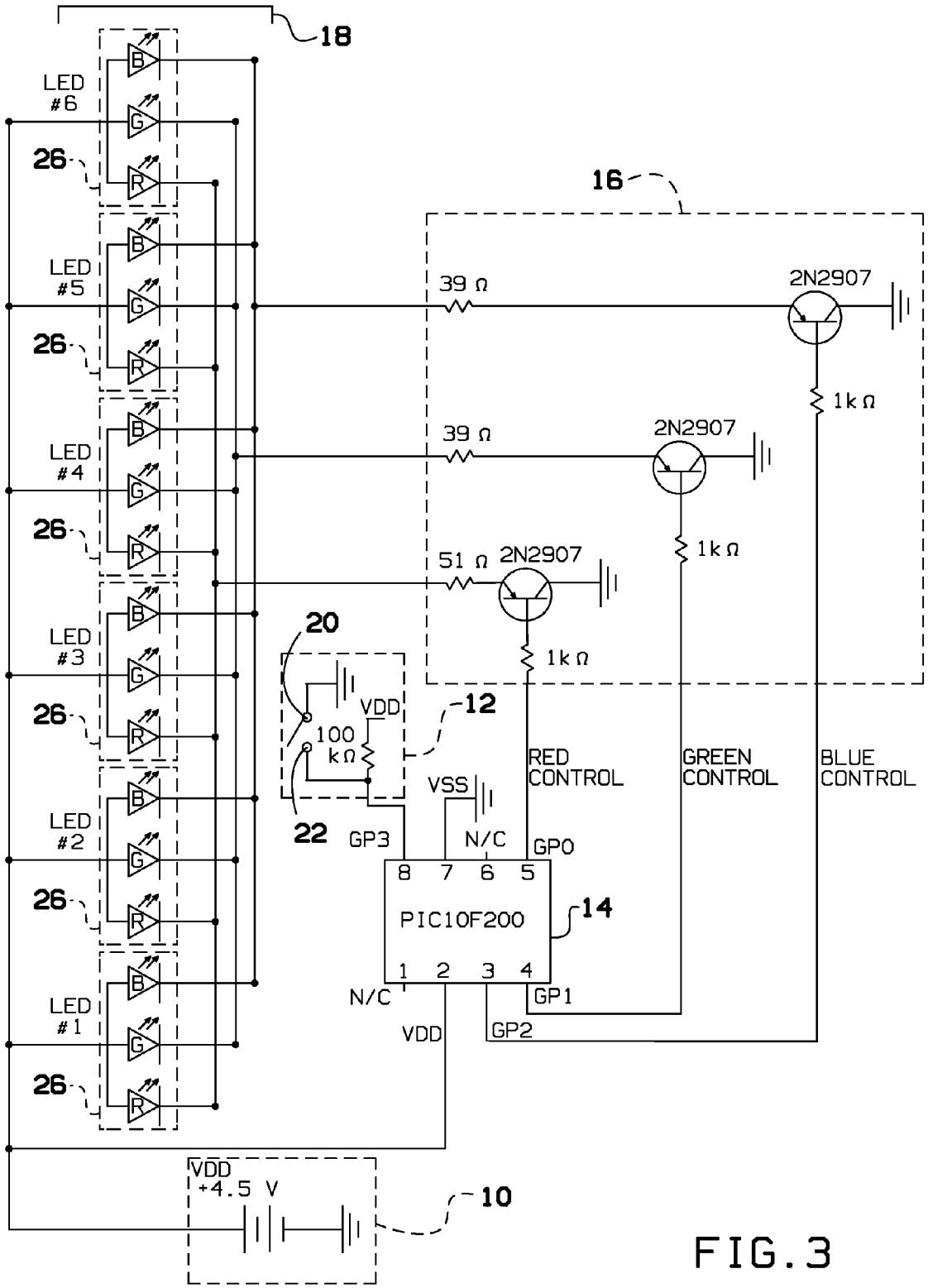
FIG. 3 is an electrical schematic diagram showing the electrical design for impact sensing and light generation in the training device of the present invention.

In an exemplary embodiment, the switching means 16 uses electrical signals from the logic means 14 to switch elements of the light generating means 18 on and off. As shown in FIG. 3, the logic means 14 provides three switching output signals (one for red, one for green, and one for blue) to the switching means 16, which includes three separate PNP transistors combined with three current-limiting resistors. The transistors are model 2N2907 sold by Radio Shack of 300 RadioShack Circle, Fort Worth, Tex. 76102.

It is also possible to substitute other switching means know in the art, or to use the electrical output from the logic means 14 to provide power directly to the light generating means 18, eliminating the need for a separate component for the switching means 16.

The light generating means 18 of an exemplary embodiment of the training device includes six three-color light emitting diodes (LEDs), or LEDs 26. The LEDs 26 are model 276-028 sold by Radio Shack of 300 RadioShack Circle, Fort Worth, Tex. 76102. As shown in FIG. 3, Each LED 26 includes a common anode and three cathodes (one for red, one for green, and one for blue). The color cathodes from each of the LEDs 26 are connected in parallel to the corresponding color control transistor in the switching means 16 through a current limiting resistor. Connected as shown, each transistor in the switching means 16 controls the on off status a single color of light (red, green, or blue) for all the LEDs.

There are many alternate methods to generate light available in the art. Although the above exemplary embodiment includes three colors, any variation in color, intensity, frequency, pattern, and duration of light flashes are contemplated within the scope of the present invention.

Figure 4:
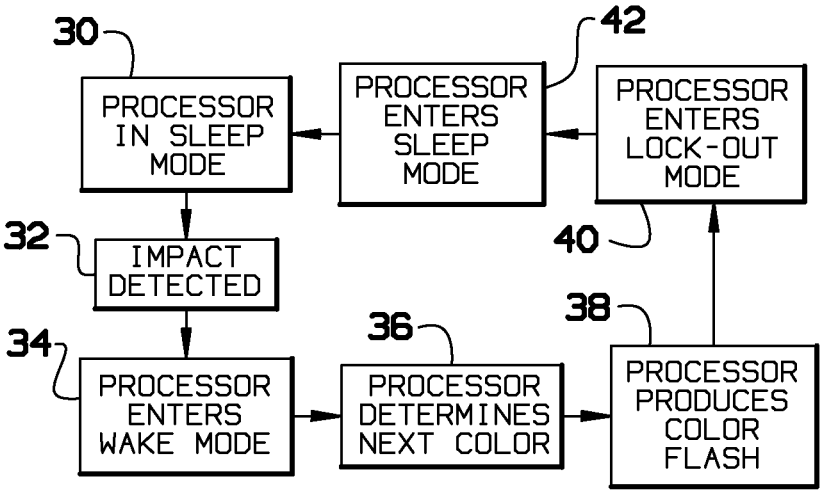
FIG. 4 is a flow chart describing an operational cycle for a logic circuit according to an exemplary embodiment of the present invention.

The operational cycle of the logic means 14 is shown FIG. 4. In an exemplary embodiment, the logic means 14 determines and controls the time, duration, and color of light flashes in response to a detected impact or acceleration. To conserve electrical power, the logic means 14 can remain in a sleep mode 30 while waiting for a signal resulting from an acceleration or impact. The sleep mode is a low power state provided as a feature of the microprocessor used in an exemplary embodiment. The logic means is configured to enter wake mode 34 whenever a signal level changes on the input pin connected to the impact sensing means 12, indicating that an impact was detected 32 (as described earlier).

Once the logic means enter wake mode 34, the processor determines the next color 36 for the flash of light that will be used for this cycle. In each cycle, one color (red, green, or blue) is used in a single flash. In an exemplary embodiment, the logic means 14 uses a stored array of 64 pseudo-random two-bit numbers to obfuscate the color sequence, making it difficult for an athlete to predict the next color under typical usage. During each wake cycle, the logic means 14 retrieves the next color in the stored sequence. Many alternate methods may be also used to create random, pseudo-random, or difficult-to-predict colored flashes. Likewise, signal flashes are not limited to single pulses of red, green, or blue light, but may include pulse sequences and flash patterns of one or more colors. It is also possible to provide a means to let a coach or other training personnel preselect a color and/or pattern of the flash prior to use.

After determining which color of light to use, the logic means 14 outputs a signal to the switching means 16 that produces a color flash 38 by the light generating means 18. The duration of the flash (the illumination event) in an exemplary embodiment is less than 1,000 milliseconds (ms), typically less than 500 ms, often the duration may be approximately 100 ms, although longer and shorter intervals are also contemplated within the scope of the present invention. The duration of the pulse is designed to ensure that visual focus must be directed toward the point of impact to see the flash unambiguously. Making the sequence of colors and/or patterns of light difficult to predict helps eliminate a tendency to guess, reinforcing the ability of a coach or training personnel to confirm that the athlete correctly witnessed the flash.

After producing a color flash, the logic means enters a lock out mode 40. The lock out mode prevents the logic means 14 from generating another color flash due to oscillations in the impact sensing means 12. The lockout mode duration is set according to the use anticipated. In an exemplary embodiment, a lock out mode duration of approximately 2 seconds can be used. During the lockout mode, no new color flashes are generated, regardless of the magnitude of the accelerations or impacts on the device.

Once the lockout mode 40 is completed, the logic means 14 enters sleep mode 42, and returns to the beginning of the operational cycle.

Figure 5:
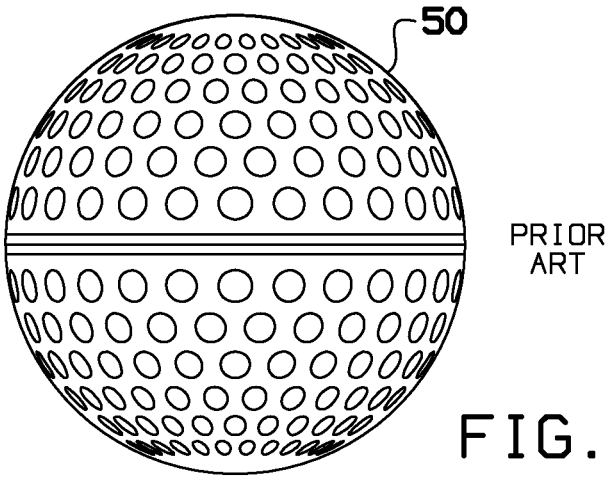
FIG. 5 is a side view of a conventional training baseball in the prior art.

The training device according to an exemplary embodiment of the present invention may be incorporated into an existing training baseball 50, shown in FIG. 5. The training baseball 50 used for in this exemplary embodiment is sold by Jugs Sports at 11885 SW Herman Rd., Tualatin, Oreg. 97062. Similar training baseballs available from other manufacturers could also be used. The training baseball 50 is designed to be used in ball-throwing machines, and is more durable than standard baseballs. The training baseball 50 is constructed of a uniform-density, semi-rigid polymer with a substantially similar size and weight of a standard baseball.

FIG. 5 shows a cross section of the training baseball after it is prepared for installation of the preferred embodiment. Six LED mounting holes 52 (four shown) are drilled along orthogonal axes of the training baseball 50. A separate, larger access hole 54 is drilled to the center of the training baseball 50. Using the access hole 54, a void 56 is carved out from the interior of the training baseball 50. The void 56 connects the LED mounting holes 52 and the access hole 54, but leaves a semi-rigid outer shell of the original training baseball 50.

Figure 7:
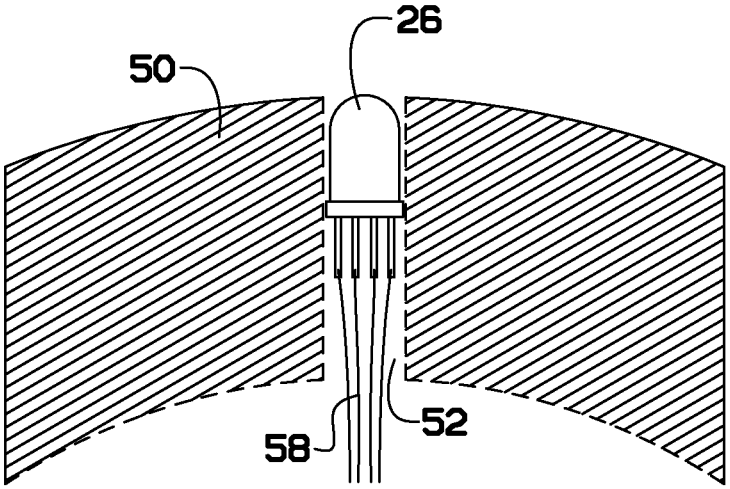
FIG. 7 is a detailed cross-sectional construction view of the ball of FIG. 6.
Figure 8:
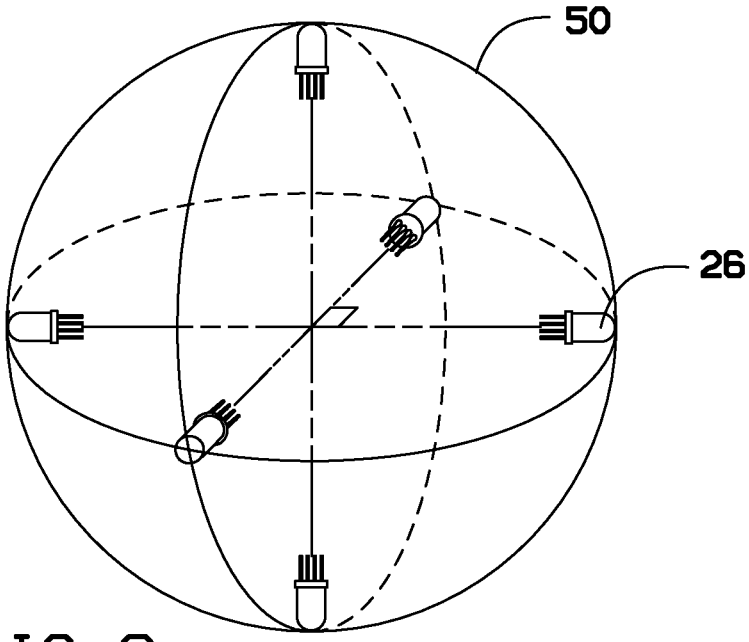
FIG. 8 is a perspective view showing light placement and orientation in a ball according to an exemplary embodiment of the present invention.

One LED 26 is inserted into each of the six LED mounting holes 52 as shown in FIG. 7. Lead wires 58 from the LEDs 26 pass through the mounting holes to connect to the rest of circuit described previously (see FIG. 3). FIG. 8 shows the placement and orientation of the six LEDs 26 around the surface of the training baseball 50. In the preferred embodiment, the LEDs 26 are arranged such that it is possible to view a flash of light when the training baseball 50 is in any orientation relative to the athlete.

Figure 6:
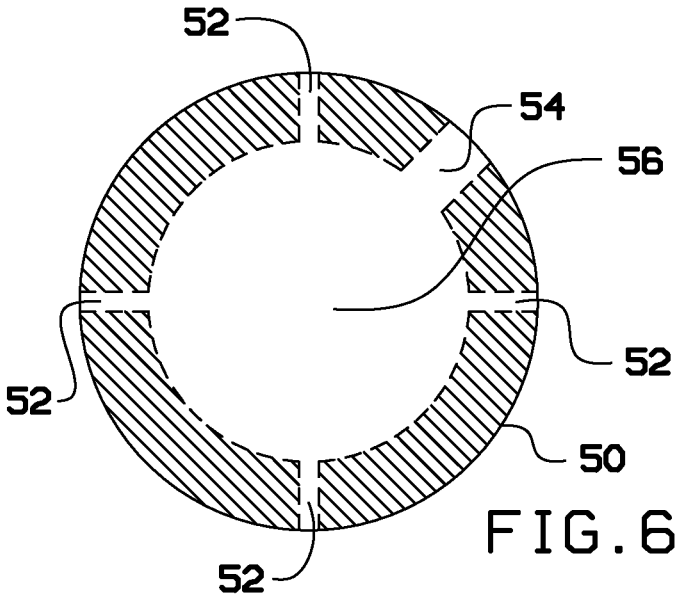
FIG. 6 is a cross-sectional construction view of a ball according to an exemplary embodiment of the present invention.
Figure 9:
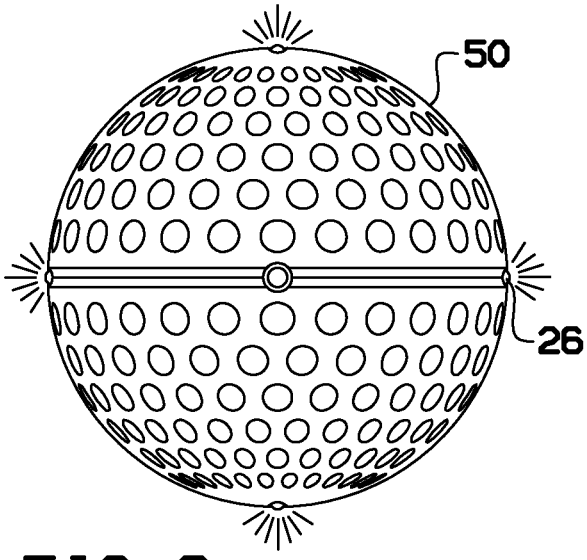
FIG. 9 is a side view of a ball having a plurality of lights for illuminating during an impact, according to an exemplary embodiment of the present invention.

After the LEDs 26 are mounted and electrically connected to the rest of the circuit, the remainder of the components (energy storage means 10, impact sensing means 12, logic means 14, and switching means 16) are inserted through the access hole 54 into the void 56 (see FIG. 6). The cantilevered spring 20 of the impact sensing means 12 is covered, to prevent its motion from being restricted. The entire void 56 is filled with an epoxy resin to secure the enclosed components in a rigid form. The LED mounting holes 52 are also filled with epoxy resin from the void 56 during this process, securing the LEDs 26 and lead wires 58. The access hole 54 is filled with epoxy resin and plugged with a thin slice of the outer skin of the training baseball 50. (The plug can be retained from the original drill process to create a more cosmetic finish). The finished assembly is shown FIG. 9.

Figure 10:
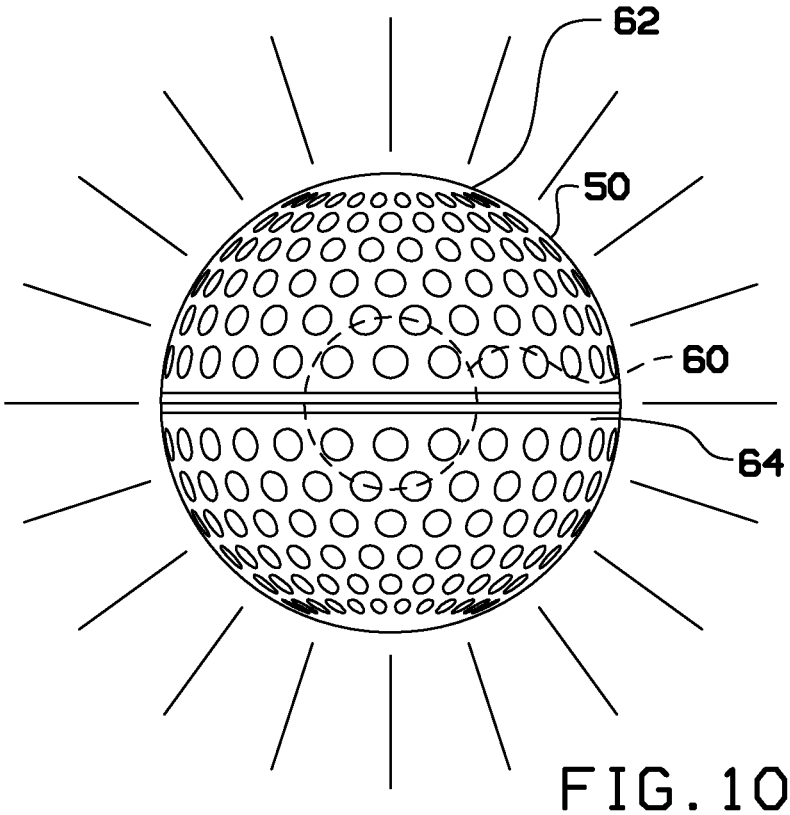
FIG. 10 is a side view of a ball having an illumination mechanism in a transparent or translucent central housing surrounded by a transparent or translucent layer, according to an alternate embodiment of the present invention.
Figure 11:
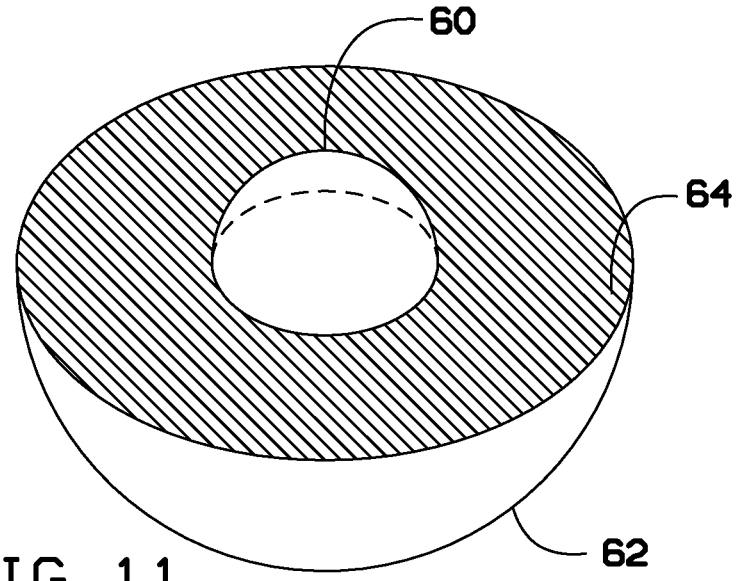
FIG. 11 is a sectional view of the ball of FIG. 10.

An alternate embodiment is shown in FIG. 10. In this embodiment, functional components of the training device are reduced in size and incorporated within a transparent or semi-transparent rigid housing, or housing 60. The housing 60 is molded into the center of a ball 62 that is composed of a transparent or semi-transparent material 64. FIG. 11 shows the approximate location of the rigid housing within the ball 60. The light generating means 12 component within the housing 60 will transmit through to the exterior of the ball 62.

To assist with training, the present invention may be usefully incorporated into any sports object that is struck or hit, including (but not limited to): golf balls, tennis balls, hockey pucks, baseballs, softballs, cricket balls, table tennis balls, squash balls, and racket balls.

The present invention is not limited to being installed on a sports object that is struck (such as a ball or puck). The present invention may also be attached to or incorporated into sports implements that are used to strike or hit objects including (but not limited to): golf clubs, tennis rackets, hockey sticks, baseball bats, cricket bats, table tennis paddles, squash rackets, and racket ball rackets.

Figure 12:
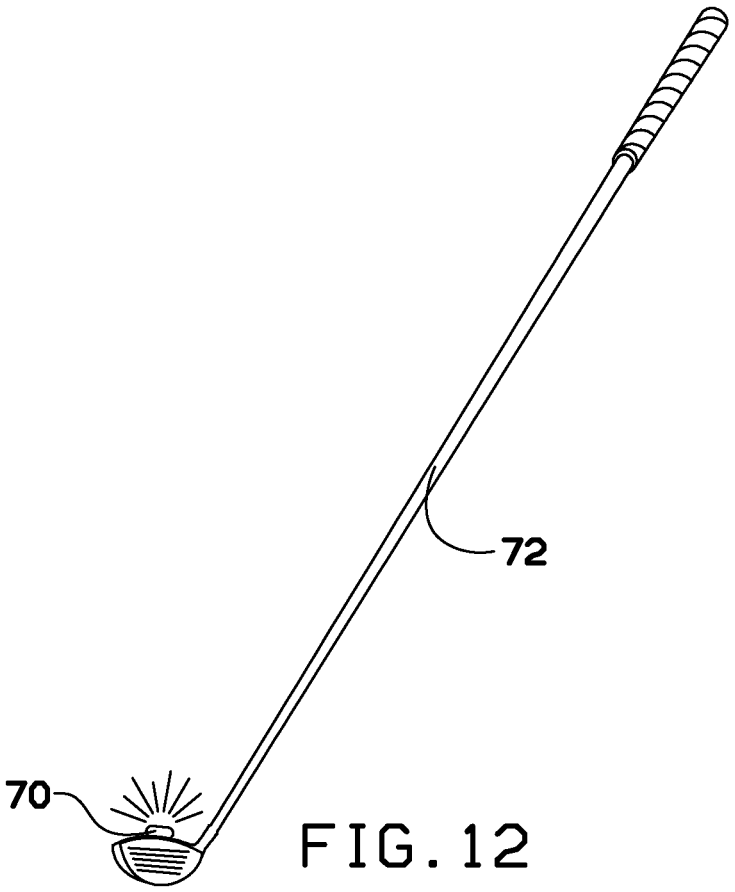
FIG. 12 is a perspective view of a golf club having a light-producing impact sensor, according to an exemplary embodiment of the present invention.
Figure 13:
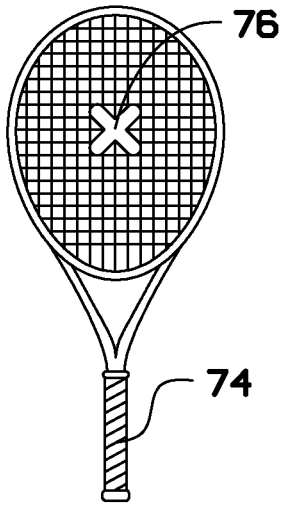
FIG. 13 is a perspective view of a tennis racquet having a light-producing impact sensor, according to an exemplary embodiment of the present invention.

For example, FIG. 12 shows an embodiment included in a housing 70 that is attached to a golf club 72. The location of the housing 70 allows a flash of light to occur approximately near the location where the club face strikes a ball during a swing, accomplishing a similar function as if the embodiment were incorporated into the ball itself. Similarly, FIG. 13 shows a tennis racket 74 with a housing 76 that includes an embodiment is affixed to the racket strings.

It should be understood, of course, that the foregoing relates to exemplary embodiments of the invention and that modifications may be made without departing from the spirit and scope of the invention as set forth in the following claims.

What is claimed is:

1. A method for training athletes to watch a ball at a point of impact with an object used while playing a sport, the method comprising:

impacting the ball with the object;

determining a color for lighting at least one light on either the ball or the object;

producing an illumination event including at least one flash of light in the at least one light at an impact time; and entering a lockout mode for a predetermined period of time to prevent another illumination event from occurring.

2. The method of claim 1, wherein the illumination event occurs for a duration of less than 1,000 milliseconds.

3. The method of claim 1, further comprising focusing on the impact to identify the color of the at least one flash of light in the at least one light.

4. The method of claim 1, further comprising flashing lights positioned in at least six different, equidistant-spaced locations on a periphery of the ball.

5. The method of claim 1, wherein the at least one light illuminates a central region of the ball surrounded by a transparent or translucent outer periphery.

6. A method for training athletes to watch a ball at a point of impact with an object used in a sport, the method comprising:

impacting the ball with the object;

determining a color for lighting at least one light on either the ball or the object;

producing an illumination event including at least one flash of light in the at least one light at an impact time; and entering a lockout mode for a predetermined period of time to prevent another illumination event from occurring, wherein the illumination event occurs for a duration of less than 1,000 milliseconds.

7. The method of claim 6, wherein the illumination event creates one color light in a single flash.

8. The method of claim 6, further comprising focusing on the impact to identify the color of the at least one flash of light in the at least one light.

9. The method of claim 6, further comprising flashing lights positioned in at least six different, equidistant-spaced locations on a periphery of the ball.

10. The method of claim 6, wherein the at least one light illuminates a central region of the ball surrounded by a transparent or translucent outer periphery.

* * * * *